United States Patent [19]

Wrigley, Jr.

[11] 4,225,318

[45] Sep. 30, 1980

[54] METHOD OF MAKING HYDROCARBON COMPOSITION

[76] Inventor: Hank J. Wrigley, Jr., 2000 Reservoir Rd., Apt. 107 Warren House, Little Rock, Ark. 72207

[21] Appl. No.: 904,797

[22] Filed: May 11, 1978

[51] Int. Cl.[3] ..... C10L 11/06; C10L 7/02

[52] U.S. Cl. ..... 44/40; 44/7 D

[58] Field of Search ..... 44/7, 40

[56] References Cited

U.S. PATENT DOCUMENTS

| | | | |
|---|---|---|---|
| 3,615,286 | 10/1971 | Vander Linden | 44/7 D |
| 3,801,292 | 4/1974 | Tanner | 44/7 D |
| 3,846,086 | 11/1974 | Balch et al. | 44/40 |
| 4,083,697 | 4/1978 | Smith et al. | 44/7 D |

*Primary Examiner*—Carl F. Dees

*Attorney, Agent, or Firm*—Donald M. Cislo

[57] ABSTRACT

A composition which in its initial stage is useful for several end uses. The initial or primary composition becomes an absorbent for oil and similar hydrocarbons that would otherwise present pollution problems whereas by the addition of a liquid hydrocarbon such as kerosene, the initial composition is converted into a material which upon packaging and solidification into briquette-like shapes is useful as a fire starter for camp fires, fireplaces, barbecuing or any other similar application. Another end product is obtained by addition of combustible, solid material and shaping of the composition into logs or other shapes which themselves utilize waste or refuse material and which may be utilized as any normal combustible material for heating and/or lighting.

3 Claims, 6 Drawing Figures

METHOD OF MAKING HYDROCARBON COMPOSITION

BACKGROUND OF THE INVENTION

Recently, the ecological movement has become very cognizant of the pollution problems as caused by oil spills on bodies of water. Additionally, with today's transient mobile population and the call of the outdoors beckoning to campers, picnickers and the like, the ability to start fires easily and safely for heating or cooking purposes becomes important. Attendant with the population growth and the desire to curtail pollution of one type or another is the problem of disposing of refuse and other waste products from man's insatiable thirst for consumption.

All of the afore-alluded to problems are eased or solved by the invention herein in that a basic, initial composition is available which acts as an absorbent to clean up oil spills acting much like a desiccant or sponge. By the simple addition of a liquid hydrocarbon, such as kerosene or alcohol, a flowable combustible mixture is obtained which may be easily packaged into briquette-like shapes for utilization as a fire starter for camp fires, utilizing wood, charcoal or similar combustible materials. The same composition may have added to it, finely divided combustible material such as orange peels, corncobs and similar such material so as to provide a moldable, extrudable mixture which upon solidification becomes much like a wooden log or other conventional type of fuel whether it be organic or fossil.

While there has been some attempt in the prior art to overcome oil spill pollution problems and to provide a firestarter for starting barbecue or camp fires and attempts made to utilize what may be considered solid organic waste, none have been successful in meeting the challenges or needs of all three in one basic, primal composition or by providing an ultimate product which the invention herein disclosed achieves.

In all instances the compositions of this invention, regardless of ultimate end use and intermediate processing, take the form of a gel, gel-foam and/or gel state as will become apparent as the description proceeds herein.

OBJECTS AND SUMMARY OF THE INVENTION

It is an object of the invention to provide an initial or basic composition which is capable of forming a stable gel, foam and/or gel-foam.

It is another object of the invention to provide a stable gel, gel-foam and/or foam composition which is utilizable as an absorbent for oil spills.

It is another important object of the invention to provide an initial or basic composition in stable gel, gel-foam and/or foam form to which may be added a liquid hydrocarbon and the resulting mixture of which is packagable and eventually solidifiable into a fire starting composition.

It is another object of the invention to provide a stable gel, gel-foam and/or foam composition to which may be added combustible solid waste material which thereafter is extrudable, moldable and solidifiable into log configurations to provide a fuel mass.

It is still another and more specific object of the invention to provide a fire starter composition which is packaged in such a manner that the user thereof does not take unnecessary risks nor is he subjected to uncleanly handling of the fire starter material.

It is another still more specific and important object of the invention to provide a fire starter package in briquette-like configuration wherein a composition is packaged with a volume of combustion supporting gas in a novel and unique manner.

It is still another more specific object of the invention to provide a fire starter package of material wherein the composition is initially in the flowable form and after packaging solidifies into a solid combustible mass which is easily ignited.

It is another object of the invention to provide a method of packaging a fire starting composition so as to provide an easy to use and safe material.

It is still another object of the invention to provide a method whereby a formed, solid combustible mass is obtained from a flowable gel, gel-foam and/or foam substance which is extruded, pumped or injected into hermetically packaged form.

Basically, an exemplary embodiment of the invention pertains to an initial composition of substantially stable gel, gel-foam and/or foam comprising a resin in solution selected from the group of natural and synthetic resins. A foam-forming agent selected from the group of surfactants, soaps and detergents, along with a sufficient amount of liquid such as acid and/or base treated water, comprises the salient components of the composition. Upon mechanical agitation, a tenacious gel, gel-foam and/or foam is formed as required which is substantially devoid of free liquid and hence the proportions of the material are controlled so as to have a substantially liquid-free gel, gel-foam and/or foam.

In one instance, the initial composition may itself be used as an absorbent for oil spills in order to clean up same or may have added to it, a liquid hydrocarbon such as for example, kerosene, which upon agitation, may be formed into a flowable, pumpable mixture which may be itself molded into briquette-like shapes or preferably is pumped into cellophane-polyethylene packages with a sufficient amount of air which upon solidification, forms a fire starter package. In other instances, the starting composition may have added to it, a solid combustible filler along with other combustible materials as for example, oil residues, etc. so as to form a log (or other molded shape) fuel of economical cost and having the attribute of ridding the countryside of man's refuse.

These and other objects of the invention will become apparent from reference to the drawings and the hereinafter following commentary.

DESCRIPTION OF THE BEST EMBODIMENTS CONTEMPLATED

Figure 1:
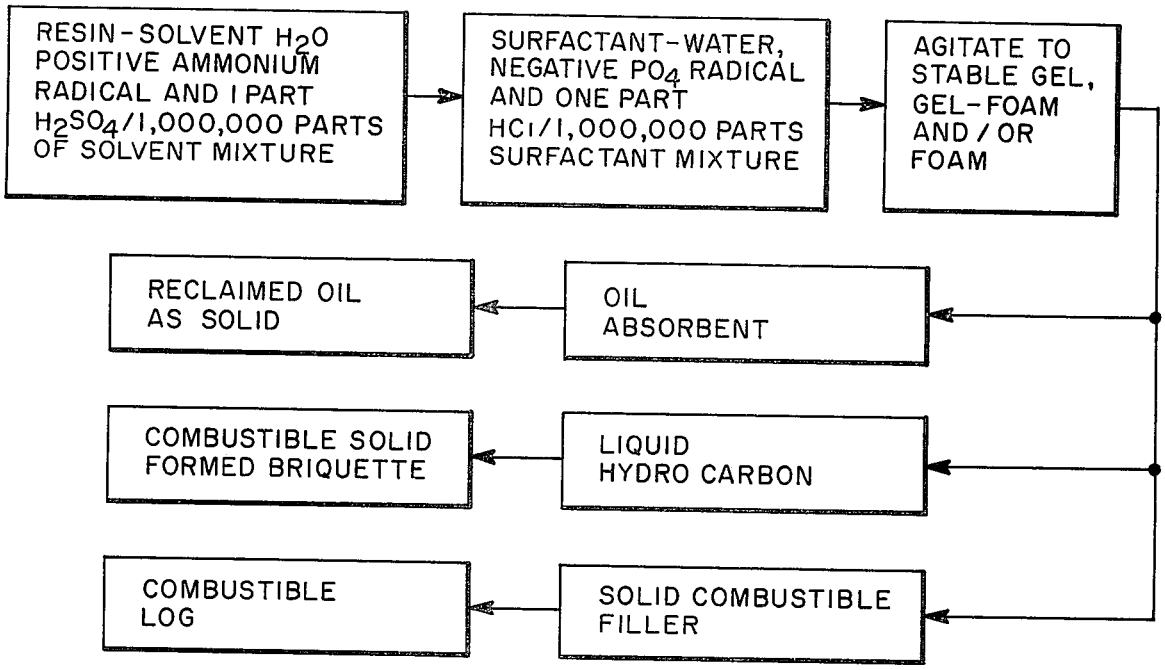
FIG. 1 is a flow diagram showing the practice of the invention to reach the three principal compositions of the invention.

Referring to FIG. 1 of the drawing, the basic inventive concepts of the invention are disclosed. In order to form the basic or initial material, a resin which may be any of the synthetic or natural ones, and which is commercially available in dissolved form in a solvent, with added negative and positive radicals compatible with the resin or rosin, forms the initial ingredient of the composition. The types of resins that have been found to be useful are the ureaformaldehyde ones commercially available from American Cyanamid Company and designated under their identification numbers as 175 and 180. To the resin-solvent mixture, which as indicated contains the resin in most finely divided emulsion form, is added a surfactant, soap or detergent water mixture. The surfactant, soap or detergent mixture, with a sufficient amount of water, base and added ingredient actually acts as a resin-disbursing agent and a film foam-forming agent, which through mechanical agitation, creates a stable gel, gel-foam and/or foam. The resultant mass, which is actually the starting composition for the basic concept of the invention, may be a stable, sponge film-like, cubic grid of a volume approximately 100 times greater in volume than the combined volume of the original total resin and film foaming solutions. The original molecules of resin and/or wax and other components in the starting composition, are disbursed to the maximum volume and each individual particle and/or groups of particles are properly film encapsulated. The resultant mass of the starting composition is established in a predetermined stable gel, gel-foam and/or foam state of specific characteristics predicated upon and designed for the most convenient efficient absorption and conveyance of one of the many specific greatly larger hydrocarbon masses intended for the ultimate end use.

The stable gel, gel-foam and/or foam thus formed may comprise about one part in twelve by weight of resin and one part in twelve by weight of a film foam-forming agent preferably of a non-phosphate detergent, many of which are well known in the art and commercially available.

The gel, gel-foam and/or foam thus formed is substantially liquid-free and thus when formed, the liquid proportions of the resin-solvent mixture and the film foam forming agent, should be proportioned with the water or other liquid so that the gel, gel-foam and/or foam which meets the foregoing criteria is formed. The initial compound in the gel, gel-foam and/or foam state is substantially of viscous, sprayable, pumpable nature and in this form may be utilized as an oil spill absorbent to absorb floating oil or other spilled oil, which would otherwise present a pollution problem. This initial composition acts very much like a sponge to absorb the spilled oil to substantially entrain and encapsulate it within its interstices.

Figure 3:
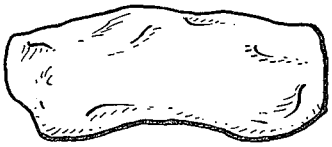
FIG. 3 illustrates a portion of the liquid-free gel, gel-foam, and/or foam composition in the solidified state after it has served its purposes as an oil absorbent.

As shown in FIG. 3, to solidify the stable gel, gel-foam and/or foam having oil entrained therein, acid additives and/or acid-producing additives will have been originally added to the original initial composition with proper buffers in a separate film-injected encapsulation. This is a naptha fatty acid type film which only releases the acid radicals and/or acid-producing materials after the starting composition absorbs the total volume of the greatly larger hydrocarbon (oil) mass. The acid radicals when released attack the total unit area mass and release minute traces of ammonia gel which when released, permit all excess liquids and gasses in the mixture to join, or bond in new, long molecular chain structures of resin chains and methane crystals thereby solidifying the entire mass.

Upon the formation of the stable gel, gel-foam and/or foam as described, where it is desired to form a fire starting composition, an amount of an acid-forming material, capable of establishing the proper acid content out of the greatly larger hydrocarbon mass (kerosene), will have been added with proper buffer to the resin solvent, surfactant or soap, solutions, after which the greatly larger hydrocarbon mass is added. The liquid hydrocarbon will ultimately form about 100 to 111 parts by weight in a composition of 112 to 123 parts. Thus, it is apparent that the liquid hydrocarbon comprises the majority of the fire starting compositions. The amount of acid former added, either in the form of the acid itself, or in the form of a material which makes the acid radical available, would be approximately that amount of acid so as to permit solidification of the liquid-gel, gel-foam and/or foam mixture upon extrusion, or packaging into appropriate packages as will be described.

The type of liquid hydrocarbon that may be used comprises any of those such as kerosene, gasoline, naptha methanol and any of the petroleum distillates of the various cuts, but kerosene, because of its low volatility, and relative safety, is preferred. Upon mechanical agitation of the liquid hydrocarbon into the stable gel, gel-foam and/or foam, a flowable mixture is obtained which may be formed into a briquette-like shape configuration or may be pumped into a cellophanepolyethylene package.

Figure 2:
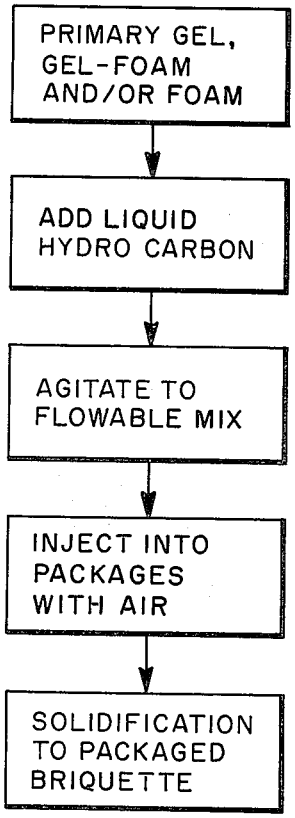
FIG. 2 is a block diagram showing the formation of a packaged fire starter of the invention.

For example, referring to FIG. 2, it is apparent that the primary or initial composition as disclosed above, has added to it, the liquid hydrocarbon and preferably an amount of an acid forming material, such as for example, treated walnut shells, and this mixture is agitated to form a flowable mix of foam or gel and combination thereof nature. The mix is then injected into packages having polyethylene walls which are heat sealed at opposed ends thereof and having a cellophane exterior. The amount of substance injected into the packages is such so that approximately 25% of the volume of the package is occupied by combustion supporting gas or in the preferred case, air. Upon standing, the flowable mixture solidifies to a briquette-shaped member which is easily ignited and which provides sufficient heat value to kindle most combustible materials including charcoal, wood and other combustibles.

Figure 4:
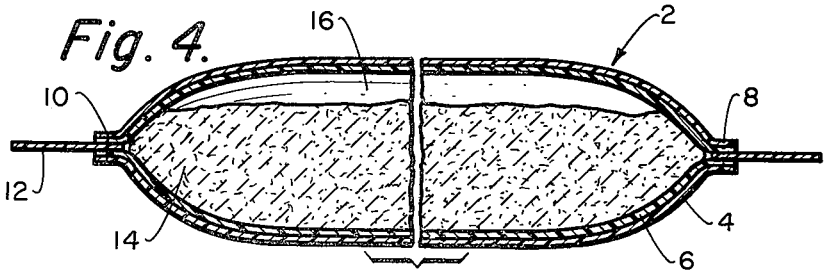
FIG. 4 is a greatly enlarged, exaggerated view in side elevation of a packaged fire starting composition of this invention in briquette-like form.
Figure 4A:
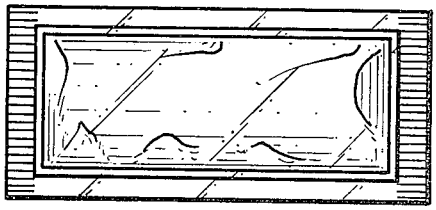
FIG. 4*a* is a top view of the package illustrated in FIG. 4.

Referring to FIG. 4, it will be noted that a package 2 has an exterior cellophane layer 4 and an interior polyethylene layer 6 heat sealed at the ends 8 and 10 thereof. Around the package on ends 8 and 10 and on both sides the polyethylene in cellophane is hermetically heat sealed for a width of approximately ¼ inch. So as to preclude the fire starter pack user having to open the sealed pack to ignite this ¼ inch wide sealed area 12 all the way around the pack is designed and of proper combustible combinations of polyethylene and cellophane to serve as the wick for igniting the pack, and the burning pack plastic material ignites the internally hermetically sealed fire starter material inside.

The solidified fire starter 14 occupies about 85% of the volume whereas the upper portion 16 of package 2 is occupied by air. The amount of air may be varied but about 12% to 15% of the total volume of package 2 is desirable so as to provide an effective fire starter package 2 and to provide necessary combustion supporting gas for the fire starter composition 14.

Figure 5:
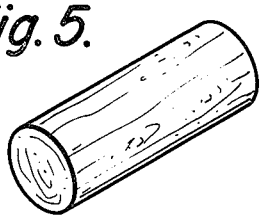
FIG. 5 illustrates a molded article of this invention utilizing solid or finely divided waste material which is utilizable as a fuel itself.

Referring again to FIG. 1, it will be noted that the primary composition may have added to it, a combustible material such as residue, oil, bunker fuel, or similar such materials including kerosene in the amount of 5–10% and to this may be added an amount of solid combustible filler material which preferably is in the finely divided state. The combustible filler material may take the usual form of any refuse such as sawdust, ground corncobs, husks or any similar material including orange peels which forms a somewhat dense moldable mixture which may be formed into fuel material such as the log illustrated in FIG. 5. This log then may be used as any fuel in fireplaces, camp fires, etc.

Thus, there has been disclosed a basic composition which may be utilized for a myriad of end uses, all of which are intended to be covered in the appended claims.

To illustrate each one of the embodiments of the invention, the following examples will be useful.

EXAMPLE I

Component parts A, B, C and D are prepared and/or made available comprising:

| Component A: | |
|---|---|
| 11,355 mls | water |
| 1,892 mls | commercial detergent |

Mixed without foaming and treated, if necessary, to a pH number of about 4.9.

| Component B: | |
|---|---|
| 5 grams | sodium lauryl sulfate |
| 3 mls | 1% solu. hydrochloric acid |
| 10 grams | aluminium carbide |
| 10 grams | trisodium phosphate |
| 10 grams | sodium tetra-borate |
| 30 grams | ethyl alcohol saturated cornstarch |
| **Component C:** | |
| 5,677 mls | commercial grade urea-formaldehyde |
| **Component D:** | |
| 1,892 mls | water |
| 30 grams | aluminium oleate |
| 30 grams | ammonium chloride |
| 75 mls | 5% solu. sulfuric acid |
| (Maintain pH number between about 6.8–7.4) | |

To Component A, under slow agitation is added Component B, the mixing time being about four minutes.

Component C is agitated at high speed (1,750 RPM) until a thick foam is produced (about 1 minute). Thereafter, Component D is added to Component C and both are mixed at about 1,750 RPM until complete dispersal of D in C.

To the C-D mixture is added the A-B mixture under low agitation (150 RPM), mixing continuing for about 1 minute and greatly increased to about 1,750 RPM for 1 minute introducing large quantities of air into the mixture.

The foregoing has now resulted in the formation of a stable gel and/or foam which may now be used in creating one or more component parts of the invention.

EXAMPLE II

To the formulated gel and/or foam of Example I is added about 113,550 mls of liquid hydrocarbons, for example, kerosene. The hydrocarbon is introduced at about the rate of 56,775 ml/min.

After addition of all of the liquid hydrocarbon, agitation at about 1,750 RPM is continued for about 2 minutes, producing a pumpable emulsion-gel which will not solidify for about four hours.

The resultant mass of Example II may then be pumped, FIG. 2, or introduced into packaging equipment to package the emulsion-gel into individual packs, as illustrated in FIG. 4.

To carry out the oil absorbent aspect of the invention, the following examples will be illustrative.

EXAMPLE III

Equal parts of urea-formaldehyde resin, a commercial grade, and ocean water are mixed to form component A-1. While mixing at 750 RPM there is added component B-1, comprising:

| | |
|---|---|
| 15 gallons | commercial detergent |
| .5 gallon | hydrochloric acid |
| 5 lbs. | sodium tetra-borate |
| 5 lbs. | calcium phosphate |
| 5 gallons | liquid hydrocarbon, kerosene |
| 50 lbs. | nut shell dust |
| 10 lbs. | aluminium carbide |

The mixture is agitated under no-foam conditions for about 2 minutes, thereby producing a rather fluid emulsion gel which has a viscosity low enough to allow spraying thereof.

To an oil spill or other hydrocarbon mass is sprayed the foregoing fluid-emulsion-gel to disperse within the oil over a 15–20 minute period.

Thereafter, a 300 gallon mixture comprising:

| | |
|---|---|
| 250 gallons | ocean water |
| | to which has been added under mixing conditions: |
| 45 gallons | 2% sulfuric acid |
| 2.5 gallons | ammonium chloride |
| 5 lbs. | aluminium oleate |

This mixture is then sprayed over the previously treated area. After an elapsed time of about 30 minutes, solidification with the entrained oil is obtained. The solid material is now removed from the treated area.

To illustrate the solid combustible filler aspect of the invention, the following Example is illustrative.

EXAMPLE IV

A bath solution is prepared comprising:

| | |
|---|---|
| 15 gallons | sodium hydroxide (10% solu.) |
| 1 lb. | sodium sulfate |
| 1 lb. | aluminium carbide |
| ½lb. | calcium phosphate |
| 1 gallon | commercial ammonia water |

About 100 lbs. of finely divided, solid waste, corn cobs for example, are soaked in the above bath solution for about 24 hours.

Thereafter, a solution of:

| | |
|---|---|
| 1 gallon | commercial grade urea-formaldehyde resin |
| 5 gallons | water |
| 1 gallon | commercial detergent |

is mixed and agitated to produce an emulsion-foam.

To the emulsion-foam is added 500 ml. of carbon disulfide, 1 gallon of kerosene, and ½ gallon of non-formaldehyde commercial resin.

Thereafter, the pre-treated, finely divided, solid waste is introduced to form a slurry which is moldable and/or extendable to form logs or the like.

Thus, there has been described and illustrated an overall composition and process of achieving the end results of this invention as set forth hereinabove.

Other changes, modifications and substitutions will make themselves apparent to those of ordinary skill in the art, and all such changes are intended to be covered by the appended Claims.

I claim:

1. The method of forming a fire starting composition and packaging same comprising the steps of:

(a) forming a substantially liquid-free gel, gel-foam or foam through mechanical agitation of a resin-solvent mixture and a surfactant water mixture;

(b) adding to the stable gel, gel-foam or foam a minor amount of acid to promote solidification and a major portion of liquid hydrocarbon; and (c) injecting said flowable resulting mixture into a package having substantially gas impermeable walls with an amount of combustion supporting gas to comprise at least 15% of the volume of said package and allowing said flowable mixture to solidify after being sealed in said package.

2. The method in accordance with claim 1 wherein said gas impermeable walls of said package are formed by a cellophane layer on the exterior of a heat sealable plastic layer.

3. The method in accordance with claim 2 which additionally includes forming an approximate ¼ inch plastic to plastic seal edge perimetrically of said package, which serves both to hermetically seal said flowable mixture and serve as a lighting tab which when ignited by the user burns and ignites the internally-sealed, solidified flowable mixture.

* * * * *